US011225775B2

(12) United States Patent
Jones et al.

(10) Patent No.: US 11,225,775 B2
(45) Date of Patent: Jan. 18, 2022

(54) CYCLE TIME CALIBRATION

(71) Applicant: Deere & Company, Moline, IL (US)

(72) Inventors: Amy K. Jones, Asbury, IA (US); Kristen D. Cadman, Dubuque, IA (US); Daniel M. Kassen, Hazel Green, WI (US); Daryl I. Rober, Asbury, IA (US); Christopher R. Edwards, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 244 days.

(21) Appl. No.: 16/452,720

(22) Filed: Jun. 26, 2019

(65) Prior Publication Data

US 2020/0407943 A1 Dec. 31, 2020

(51) Int. Cl.

| | |
|---|---|
| ***E02F 9/22*** | (2006.01) |
| ***G07C 5/00*** | (2006.01) |
| ***G07C 5/08*** | (2006.01) |

(52) U.S. Cl.

CPC ..... *E02F 9/2203* (2013.01); *E02F 9/2246* (2013.01); *G07C 5/008* (2013.01); *G07C 5/0816* (2013.01)

(58) Field of Classification Search

CPC ..... E02F 9/2203; E02F 9/2246; E02F 3/438; E02F 9/264; E02F 9/2296; E02F 9/00; E02F 9/04; E02F 9/08; E02F 9/20; E02F 9/22; E02F 9/2221; E02F 9/226; E02F 9/2267; E02F 9/2278; G07C 5/008; G07C 5/0816; G07C 5/0808

See application file for complete search history.

(56) References Cited

U.S. PATENT DOCUMENTS

| | | | | |
|---|---|---|---|---|
| 8,924,094 | B2 | 12/2014 | Faivre et al. | |
| 10,125,475 | B2 | 11/2018 | Kenkel et al. | |
| 2018/0223502 | A1 | 8/2018 | Kenkel et al. | |
| 2019/0249399 | A1 * | 8/2019 | Shiina | G05B 23/02 |

FOREIGN PATENT DOCUMENTS

JP 2011038273 A 2/2011

OTHER PUBLICATIONS

German Search Report issued in counterpart application No. 102020207736.3 dated Apr. 28, 2021 (10 pages).

* cited by examiner

*Primary Examiner* — Michael V Kerrigan
(74) *Attorney, Agent, or Firm* — Michael Best & Friedrich LLP

(57) ABSTRACT

A work vehicle including a chassis, a ground engaging implement configured to move the chassis along a ground surface, a boom connected to the chassis, an arm connected to the boom, and a bucket connected to the arm. A first actuator rotates the boom with respect to the chassis, second actuator rotates the arm with respect to the boom, and a third actuator rotates the bucket with respect to the arm. A processor calculates a first cycle time of operation of the first actuator, and analyzes if the calculated first cycle time is valid. If the first cycle time is valid, the processor communicates the calculated first cycle time to a user, and if the first cycle time is not valid, the processor repeats the calculation of the first cycle time of operation of the first actuator.

19 Claims, 4 Drawing Sheets

CYCLE TIME CALIBRATION

BACKGROUND

The present disclosure relates to work vehicles and time calibration of one or more functions of the work vehicles.

SUMMARY

In some embodiments, the disclosure provides a work vehicle including a chassis, a ground engaging implement configured to move the chassis along a ground surface, a boom including a first boom portion connected to the chassis and a second boom portion, an arm including a first arm portion connected to the second boom portion and a second arm portion, and a bucket connected to the second arm portion. A first actuator includes a first portion connected to the chassis and a second portion connected to the boom. The first actuator rotates the boom with respect to the chassis. A second actuator includes a first portion connected to the boom and a second portion connected to the arm. The second actuator rotates the arm with respect to the boom. A third actuator includes a first portion connected to the arm and a second portion connected to the bucket. The third actuator rotates the bucket with respect to the arm. A processor calculates a first cycle time of operation of the first actuator, and analyzes if the calculated first cycle time is valid. If the first cycle time is valid, the processor communicates the calculated first cycle time to a user, and if the first cycle time is not valid, the processor repeats the calculation of the first cycle time of operation of the first actuator.

In some embodiments, the disclosure provides a method for calculating a cycle time for a work vehicle having a chassis, a boom rotatably connected to the chassis via a first actuator, an arm rotatably connected to the boom via a second actuator, and a bucket rotatably connected to the arm via a third actuator. The method includes sensing a first pressure proximate the first actuator, comparing the sensed first pressure to a threshold pressure, sensing a second pressure proximate the second actuator, comparing the sensed second pressure to the threshold pressure, sensing a third pressure proximate the third actuator, and comparing the sensed third pressure to the threshold pressure. The method further includes starting a timer if all of the following conditions occur: if the first sensed pressure is greater than the threshold pressure, if the sensed second pressure is less than the threshold pressure, and if the sensed third pressure is less than the threshold pressure. The method also includes further sensing the first pressure after starting the timer, further sensing the second pressure after starting the timer, further sensing the third pressure after staring time the timer, and stopping the timer when any of the following conditions occur: if the sensed first pressure is less than the threshold pressure, if the sensed second pressure is greater than the threshold pressure, and if the sensed third pressure is greater than the threshold pressure. The method further includes communicating a cycle time to a processor, determining with the processor if the cycle time is valid, and storing the cycle time with the processor if the cycle time is determined to be valid.

In some embodiments, the disclosure provides a method for calculating a cycle time for a work vehicle having a chassis, a boom rotatably connected to the chassis via a first actuator, and a bucket rotatably connected to the boom via a second actuator. The method includes sensing a first pressure proximate the first actuator, comparing the sensed first pressure to a threshold pressure, sensing a second pressure proximate the second actuator, comparing the sensed second pressure to the threshold pressure, and starting timer if the following conditions occur: if the first sensed pressure is less than the threshold pressure, and if the sensed second pressure is greater than the threshold pressure. The method further comprising further sensing the first pressure after starting the timer, further sensing the second pressure after starting the timer, and stopping the timer when either of the following conditions occur: if the sensed first pressure is greater than the threshold pressure, and if the sensed second pressure is less than the threshold pressure. The method further comprising communicating a cycle time to a processor, determining with the processor if the cycle time is valid, and storing the cycle time if the cycle time is determined to be valid.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 1:
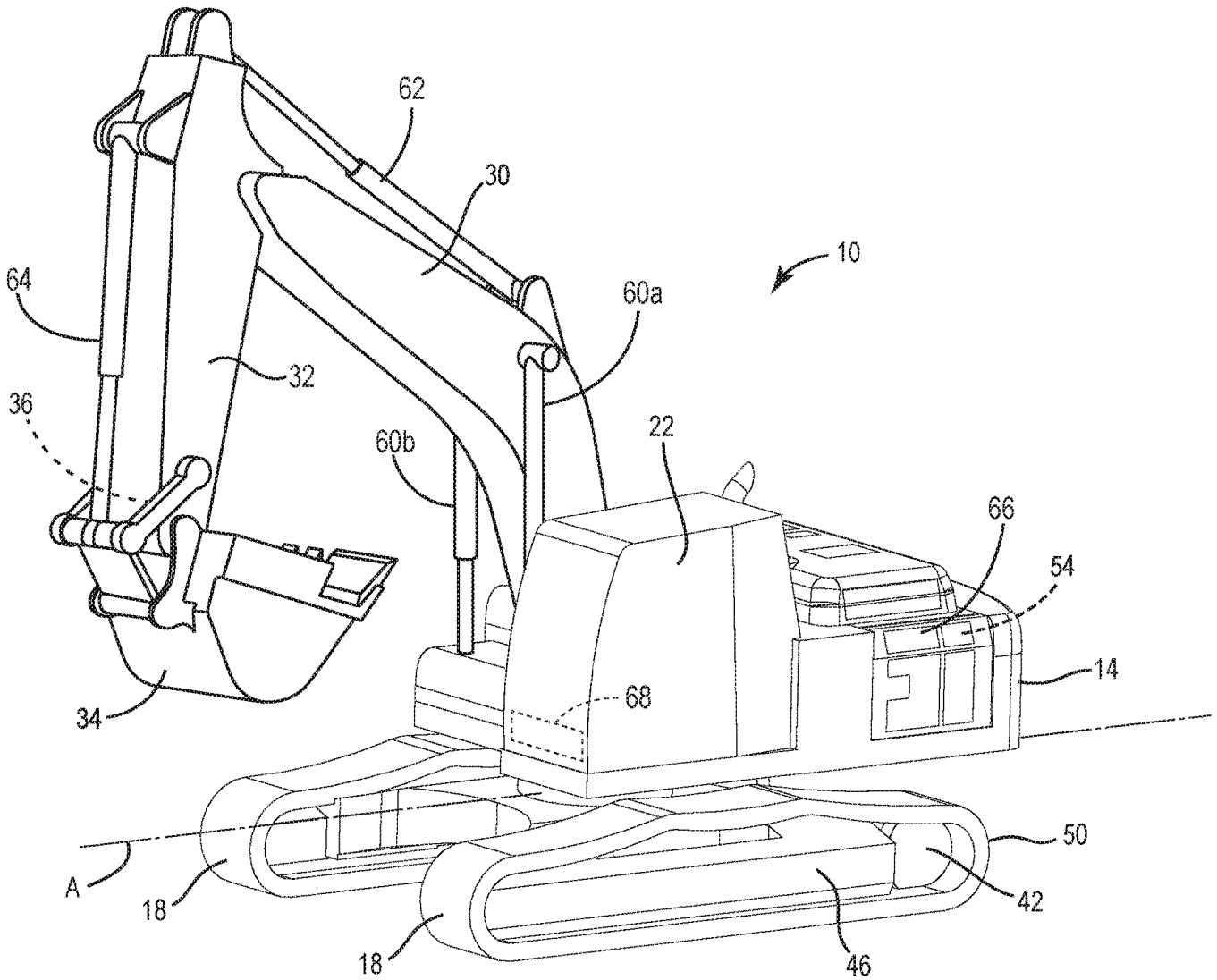
FIG. 1 is a perspective view of a work vehicle according to some embodiments.

FIG. 1 illustrates an off-highway machine, such as an excavator 10, having a chassis 14 and a ground-engaging implement (e.g., tracks or crawler mechanisms 18) for supporting and propelling the chassis 14 and therefore the machine 10 along a surface. The crawler mechanisms 18 are oriented parallel to a longitudinal axis A of the chassis 14, which coincides with a forward direction of travel of the machine 10 during operation. In the illustrated embodiment, each crawler mechanism 18 includes a drive sprocket 42, an undercarriage frame 46, and a track 50. The drive sprocket 42 is driven by a prime mover 54 and engages the track 50. The track 50 is driven in an endless loop around the drive sprocket 42 and the undercarriage frame 46. The illustrated machine 10 further includes an operator cab 22, a boom 30, an arm 32, a bucket 34 supported on an end of the arm 32, a processor 56, and a user interface 58.

The boom 30 includes a first end that is pivotally connected to the chassis 14 and a second distal end. First and second boom cylinders 60*a*, 60*b* are connected to the chassis 14 and to the boom 30. The first and second arm cylinders 60*a*, 60*b* are operable to pivot the boom 30 with respect to the chassis 14. The arm 32 includes a first end pivotally connected to the second end of the boom 30 and a second distal end. An arm cylinder 62 is connected to the boom 30 and to the arm 32 and is operable to pivot the arm 32 with respect to the boom 30. The bucket 34 is connected to the distal end of the arm 32. A bucket cylinder 64 is connected to the arm 32 and to the bucket 34 via a pivot arm 36 and is operable to pivot the bucket 34 with respect to the arm 32 via the pivot arm 36. In the illustrated embodiment, the cylinders 60*a*, 60*b*, 62 and 64 are hydraulic cylinders, but other configurations, such as pneumatic cylinders can be utilized.

Although the off-highway machine 10 is illustrated and described as an excavator, it is understood that the off-highway machine 10 may have a different form, such as a loader, a dozer, a motor grader, a scraper, or another type of construction, mining, agricultural, or utility machine. Also, although the work attachment is illustrated and described as a bucket, it is understood that the work attachment may have a different form, such as an auger, a breaker, a ripper, a grapple, or some other type of attachment for digging, breaking, handling, carrying, dumping or otherwise engaging dirt or other material. In addition, the work attachment may be detachable from the arm 32 to permit another type of work attachment to be connected to the arm 32.

Figure 2:
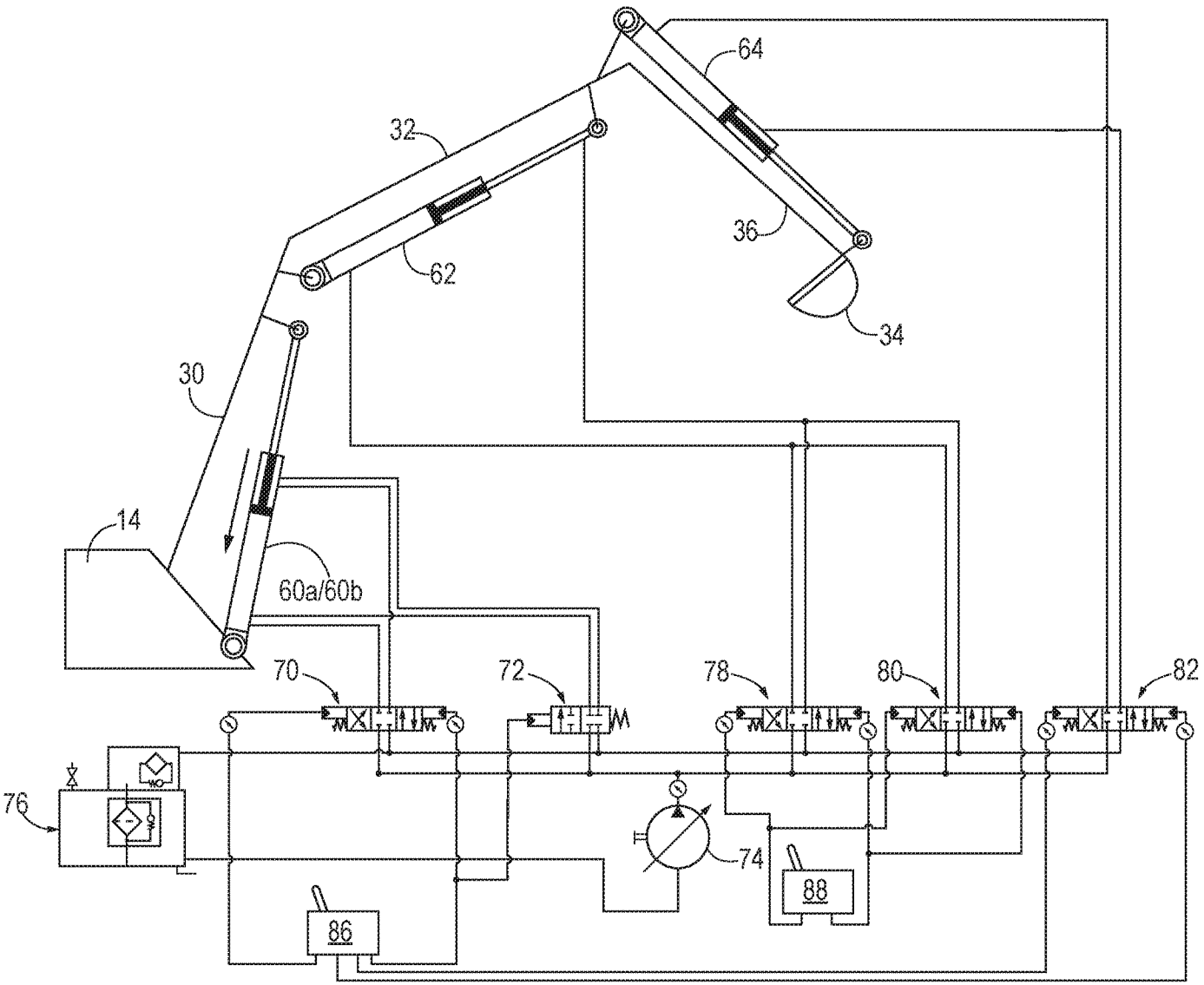
FIG. 2 is a schematic view of a hydraulic circuit according to some embodiments.

FIG. 2 is a schematic according to some embodiments. FIG. 2 illustrates that the boom cylinders 60*a*/60*b* are connected to the chassis 14 at a first end and are connected to the boom 30 at a second end. The first end of each of the boom cylinders 60*a*/60*b* is fluidly connected to a first valve 70 and a second valve 72 and the second end of each of the boom cylinders 60*a*/60*b* is fluidly connected to the first valve 70. While only one boom cylinder 60*a*/60*b* is shown, the boom cylinders 60*a* and 60*b* are substantially identical and fluidly connected in parallel to the first valve 70 and to the second valve 72. A pump 74 moves fluid from a reservoir 76 through the first valve 70 and optionally through the second valve 72 into the first end of each of the boom cylinders 60*a*/60*b* and fluid is moved from the second end of each of the boom cylinders 60*a*/60*b* through the first valve 70 into the reservoir to pivot the boom 30 upwards (counterclockwise in FIG. 2). The pump 74 moves fluid from the reservoir 76 through the first valve 70 into the second end of each of the boom cylinders 60*a*/60*b* and fluid is moved from the first end of each of the boom cylinders 60*a*/60*b* through the first valve 70 into the reservoir to pivot the boom 30 downwards (clockwise in FIG. 2).

A first end of the arm cylinder 62 is connected to the boom 30 and a second end of the arm cylinder 62 is connected to the arm 32. The pump 74 moves fluid from the reservoir 76 through a third valve 78 and optionally through a fourth valve 80 into the first end of the arm cylinder 62 and fluid is moved from the second end of the arm cylinder 62 through the third valve 78 and optionally through the fourth valve 80 in the reservoir to pivot the arm 32 upwards (counterclockwise in FIG. 2). The pump 74 moves fluid from the reservoir 76 through the third valve 78 and optionally through the fourth valve 80 into the second end of the arm cylinders 62 and fluid is moved from the first end of the arm cylinder 62 through the third valve 78 and optionally through the fourth valve 80 into the reservoir to pivot the arm 32 downwards (clockwise in FIG. 2).

A first end of the bucket cylinder 64 is connected to the arm 32 and a second end of the bucket cylinder 64 is connected to the pivot arm 36. The pump 74 moves fluid from the reservoir 76 through a fifth valve 82 into the first end of the bucket cylinder 64 and fluid is moved from the second end of the bucket cylinder 64 through the fifth valve 82 into the reservoir 76 to pivot the bucket 34 upward (clockwise in FIG. 2). The pump moves fluid from the reservoir 76 through the fifth valve 82 into the second end of the bucket cylinder 64 and fluid is moved from the first end of the bucket cylinder 64 through the fifth valve 82 into the reservoir to pivot the bucket 34 downward (counterclockwise in FIG. 2).

A first pilot control 86 is fluidly connected to both ends of the first valve 70, one end of the second valve 72 and to both ends of the fifth valve 82. The first pilot control 86 is configured to actuate the first valve 70, the second valve 72 and the fifth valve 82. Each of the fluid flow lines between the first valve 70 and the first pilot control 86 as well as the fluid lines between the fifth valve 82 and the first pilot control 86 includes a pressure sensor (shown by a circle with a diagonal arrow) configured to sense a fluid pressure in the respective flow line.

A second pilot control 88 is fluidly connected to both ends of the third valve 78 and to both ends of the fourth valve 80. The second pilot control 88 is configured to actuate the third valve 78 and the fourth valve 80. Both of the fluid flow lines between the second pilot control 88 and the third valve 78 include a pressure sensor (shown by a circle with a diagonal arrow) configured to sense a fluid pressure in the respective flow line. The cylinders 60*a*, 60*b*, 62 and 64, the valves 70, 72, 78, 80 and 82, and the pressure sensors are all electrically coupled to the processor 56.

Figure 3:
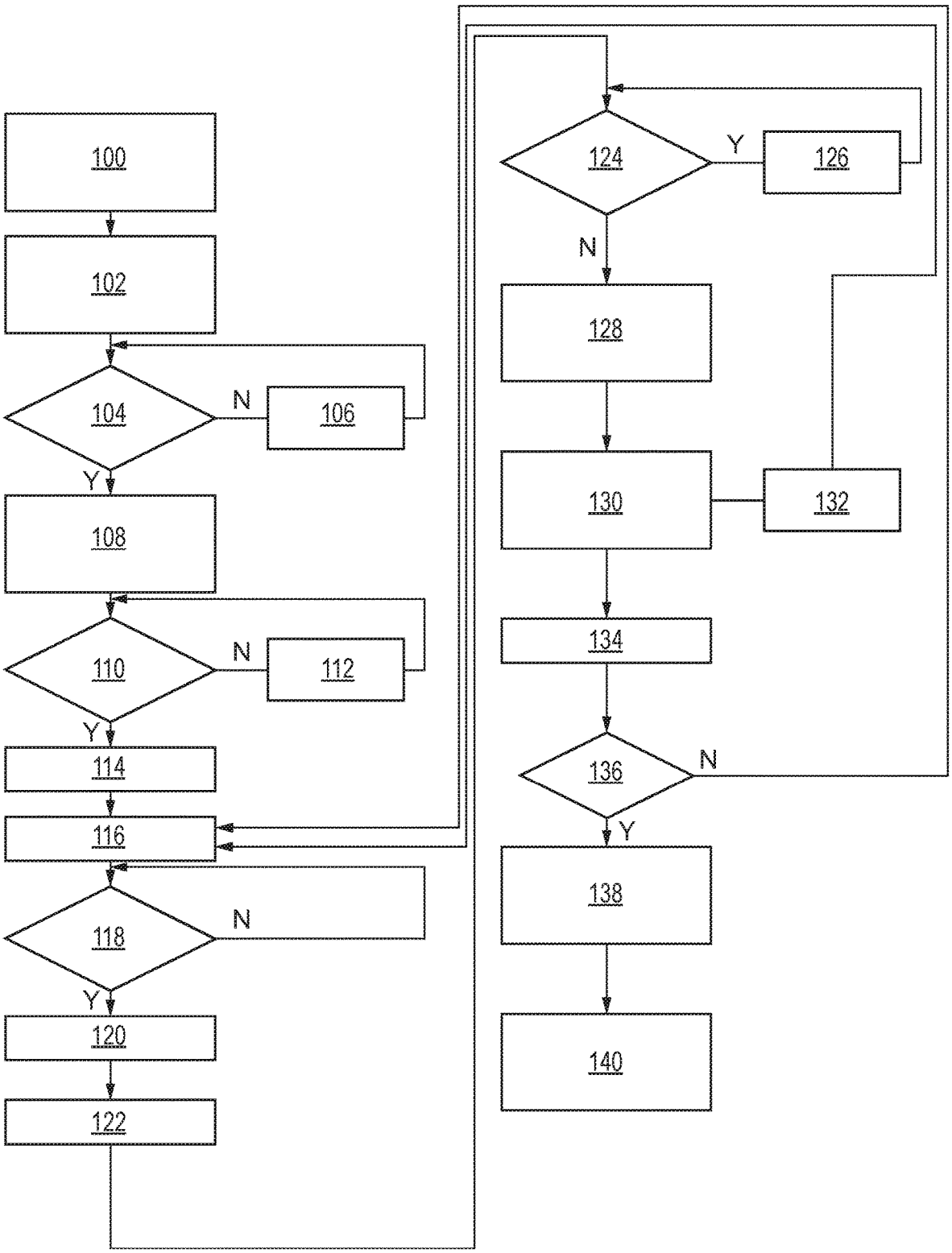
FIG. 3 is a flow chart showing one possible method of operation.

FIG. 3 illustrates one possible method of cycle time calibration according to some embodiments. Calibration testing is initiated by the operator entering a calibration application and selecting a cycle time option via the user interface 58. In step 100, the user then selects one of the following functions to test: (1) the boom cylinders 60*a* and 60*b*, (2) the arm cylinder 62 or (3) the bucket cylinder 64. By way of example, operation will be described for the operator selecting function (1), the boom cylinders 60*a* and 60*b*. In step 102, the processor 56 checks for system faults that would result in an invalid calibration. If no faults are uncovered, calibration continues to step 104.

In step 104, the temperature of hydraulic oil is also sensed and operation is permitted in safe state if the sensed temperature is above a pre-determined temperature. If the sensed temperature is too low, the machine is warmed up at step 106 until the temperature rises above the pre-determined temperature. If the sensed temperature is above the pre-determined temperature, operation proceeds to step 108. At step 108, the processor 56 sends signals to set the engine speed to maximum throttle, the mode to high power mode in which the machine will operate at maximum speed, work mode is set to dig and the automatic idle is deactivated. These signals from the processor 56 put the machine in a known state where variables relating to engine speed and performance are controlled. Therefore, the processor 56 confirms that the machine is ready to begin calibration at which time machine settings such as power mode, pressure boost and engine speed could be overridden by the processor 56 at step 108.

At step 110, the processor 56 enquires if the pilot lever has been raised. The pilot lever is controlled by the operator in the operator cab 22 and corresponds to the selected boom cylinders 60*a*/60*b*. If the pilot lever has not been raised, the operator is instructed to raise the pilot lever at step 112. If the pilot lever has been raised, operation moves to step 114 at which the operator moves the appropriate joystick to extend the selected boom cylinders 60*a*/60*b*.

At step 116, a pilot pressure at the boom pressure sensors is sensed and communicated to the processor 56. At step 118, the processor compares the sensed pressure to a first threshold pressure. If the sensed pressure is greater than the first threshold pressure, operation moves to step 120. If the sensed pressure is less than or equal to the threshold pressure, operation returns to step 116 at which the pilot pressure is sensed. At step 120, a cycle time clock is started.

At step 122, a first pilot pressure at the first valve 70 is sensed, a second pilot pressure at the third valve 78 is sensed, a third pilot pressure at the fifth valve 82 is sensed, and a change in pump pressure is sensed at the pump 74. At step 124, the sensed pressures are compared to respective threshold pressures. Operation moves to step 126, at which the processor continues incrementing the cycle time, if all of the following conditions occur:

the first sensed pressure is greater than the first threshold pressure, the second pressure is less than the second threshold pressure, the third pressures is less than a third threshold pressure, and the sensed change in pump pressure is less than the pressure change threshold.

In some embodiments the first threshold pressure is identical to the second threshold pressure. In other embodiments, the first threshold pressure is greater than the second threshold pressure. In some embodiments the second threshold pressure is identical to the third threshold pressure. In other embodiments, the second threshold pressure is greater than the third threshold pressure. Operation moves to step 128, at which the cycle time is stopped, if any of the following conditions occur:

the first sensed pressure is less than the first threshold pressure, the second pressure is greater than the second threshold pressure, the third pressure is greater than the third threshold pressure, or the pump pressure change is greater than the pressure change threshold.

At step 130, the processor determines if the cycle time is valid. In some embodiments, the processor records three cycle times and the average of the three cycle times is utilized as the cycle time for purposes of detecting validity. Some of the causes of an invalid cycle time are the operator discontinuing operation of the cycle time, the pump pressure exceeding a threshold pressure, or the rate of change of pump pressure exceeds a threshold rate. The cycle time is determined to be invalid if any of the following conditions occurred during the cycle time:

the second pressure exceeded the first threshold pressure, the third pressure exceeded the first threshold pressure, the pump pressure change was substantially equal to zero, or one or more diagnostic error codes were generated.

If the processor determines that the cycle time is invalid, operation moves to step 132 at which the cycle time is discarded and operation returns to step 116 to record another cycle time. If none of the invalidity conditions above occur, the cycle time is determined to be valid and operation moves to step 134 at which the cycle time is stored. Operation then moves to step 136 at which the processor determines if a sufficient number of cycle times have been stored. If a sufficient number of cycle times have been stored, operation moves to step 138. If a sufficient number of cycle times have not been stored, operation returns to step 116 to record another cycle time.

At step 138, the processor calculates an average cycle time from the stored cycle times and communicates the calculated average cycle time with the operator and with a network (such as a controller area network, telematics, or other suitable communication network). Then operation moves to step 140 at which the system is returned to normal operation.

The cycle time mode operation shown in FIG. 3 can be repeated for the arm cylinder 62 and for the bucket cylinder 64. Only the differences in operation for the arm cylinder 62 and the bucket cylinder 64 will be described in detail.

At step 110, if the operator selects the arm cylinder 62, the processor 56 enquires if the pilot lever has been raised. The pilot lever is controlled by the operator in the operator cab 22 and corresponds to the selected arm cylinders 62. If the pilot lever has not been raised, the operator is instructed to raise the pilot lever at step 112. If the pilot lever has been raised, operation moves to step 114 at which the operator moves the appropriate joystick to extend the selected arm cylinder 62.

At step 116, a pilot pressure at the arm pressure sensors is sensed and communicated to the processor 56. At step 118, the processor compares the sensed pressure to a first threshold pressure. If the sensed pressure is greater than the first threshold pressure, operation moves to step 120. If the sensed pressure is less than or equal to the first threshold pressure, operation returns to step 116 at which the pilot pressure is sensed. At step 120, a cycle time clock is started.

At step 122, a first pilot pressure at the first valve 70 is sensed, a second pilot pressure at the third valve 78 is sensed, a third pilot pressure at the fifth valve 82 is sensed, and a change in pump pressure is sensed at the pump 74. At step 124, the sensed pressures are compared to respective threshold pressures. Operation moves to step 126, at which the processor continues incrementing the cycle time, if all of the following conditions occur:

the first sensed pressure is less than the first threshold pressure, the second pressure is greater than the second threshold pressure, the third pressures is less than a third threshold pressure, and the sensed change in pump pressure is less than the pressure change threshold.

In some embodiments the first threshold pressure is identical to the second threshold pressure. In other embodiments, the first threshold pressure is greater than the second threshold pressure. In some embodiments the second threshold pressure is identical to the third threshold pressure. In other embodiments, the second threshold pressure is greater than the third threshold pressure. Operation moves to step 128, at which the cycle time is stopped, if any of the following conditions occur:

the first sensed pressure is greater than the first threshold pressure, the second pressure is less than the second threshold pressure, the third pressure is greater than the third threshold pressure, or the pump pressure change is greater than the pressure change threshold.

At step 130, the processor determines if the cycle time is valid. The cycle time is determined to be invalid if any of the following conditions occurred during the cycle time:

the first pressure exceeded the second threshold pressure, the third pressure exceeded the second threshold pressure, the pump pressure change was substantially equal to zero, or one or more diagnostic error codes were generated.

If the processor determines that the cycle time is invalid, operation moves to step 132. The descriptions of steps 132 through 140 for the cycle time calculation of the boom cylinders 60*a*/60*b* is identical to the operation of the cycle time calculation of the arm cylinder 62 and the bucket cylinder 64.

At step 110, if the operator selects the bucket cylinder 64, the processor 56 enquires if the pilot lever has been raised. The pilot lever is controlled by the operator in the operator cab 22 and corresponds to the bucket cylinder 64. If the pilot lever has not been raised, the operator is instructed to raise the pilot lever at step 112. If the pilot lever has been raised, operation moves to step 114 at which the operator moves the appropriate joystick to extend the selected bucket cylinder 64.

At step 116, a pilot pressure at the bucket pressure sensors is sensed and communicated to the processor 56. At step 118, the processor compares the sensed pressure to a first threshold pressure. If the sensed pressure is greater than the first threshold pressure, operation moves to step 120. If the sensed pressure is less than or equal to the first threshold pressure, operation returns to step 116 at which the pilot pressure is sensed. At step 120, a cycle time clock is started.

At step 122, a first pilot pressure at the first valve 70 is sensed, a second pilot pressure at the third valve 78 is sensed and a third pilot pressure at the fifth valve 82 is sensed, and a change in pump pressure is sensed at the pump 74. At step 124, the sensed pressures are compared to respective threshold pressures. Operation moves to step 126, at which the processor continues incrementing the cycle time, if all of the following conditions occur:

the first sensed pressure is less than the second threshold pressure, the second pressure is less than the third threshold pressure, the third pressures is greater than the first threshold pressure, and the sensed change in pump pressure is less than the pressure change threshold.

In some embodiments the first threshold pressure is identical to the second threshold pressure. In other embodiments, the first threshold pressure is greater than the second threshold pressure. In some embodiments the second threshold pressure is identical to the third threshold pressure. In other embodiments, the second threshold pressure is greater than the third threshold pressure. Operation moves to step 128, at which the cycle time is stopped, if any of the following conditions occur:

the first sensed pressure is greater than the second threshold pressure, the second pressure is greater than the third threshold pressure, the third pressure is less than the first threshold pressure, or the pump pressure change is greater than the pressure change threshold.

At step 130, the processor determines if the cycle time is valid. The cycle time is determined to be invalid if any of the following conditions occurred during the cycle time:

the first pressure exceeded the third threshold pressure, the second pressure exceeded the third threshold pressure, the pump pressure change was substantially equal to zero, or one or more diagnostic error codes were generated.

If the processor determines that the cycle time is invalid, operation moves to step 132. As noted above, the descriptions of steps 132 through 140 for the cycle time calculation of the boom cylinders 60*a*/60*b* is identical to the operation of the cycle time calculation of the arm cylinder 62 and the bucket cylinder 64.

In some embodiments, the cycle time calculation can be conducted on a work vehicle having a chassis, a boom connected to the chassis via a boom actuator, and a bucket connected to the boom via a bucket actuator. Such vehicles omit the arm and the arm actuator.

Figure 4:
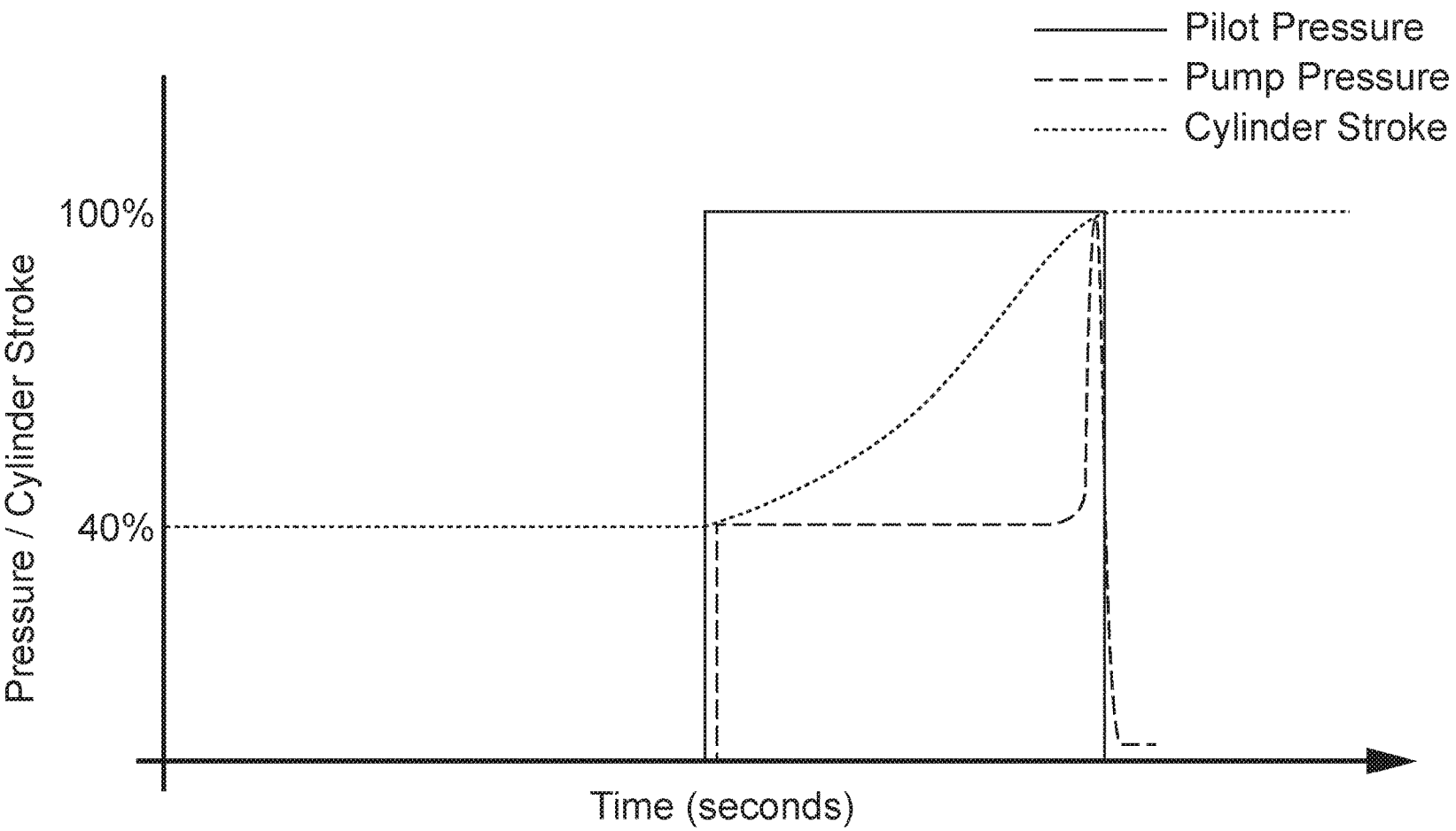
FIG. 4 is a graph of an example calculation of pressure over time.

FIG. 4 illustrates results from one test of the boom cylinders. The solid line shows the boom raise pilot pressure which is sensed near the boom joystick. The dotted line is the boom cylinder stroke which can be sensed by a position sensor and illustrates the position of the piston within the boom cylinder. The dashed line illustrates the pump pressure which is sensed by one or more pressure sensors adjacent the pump. As shown in FIG. 4, as the piston begins to move from one end of its stroke within the boom cylinder (at about 40% in the graph), the boom raise pilot pressure increases dramatically and the pump pressure increases to a moderate pressure. As the piston moves approaches the other end of its spoke within the boom cylinder (at about 100% in the graph) the boom raise pilot pressure decreases dramatically and the pump pressure increases dramatically. If the method shown in FIG. 3 were utilized during this test, the processor would begin the cycle timer when the pilot pressure increases and would stop the cycle timer when the pilot pressure decreases. These cycle time tests and methods would be continued until a suitable number of cycle times were recorded as described in detail in FIG. 3.

The cycle time method disclosed in the present application can be utilized in the field to diagnose a machine as well as in the factory for initial machine testing. In previous methods, a user would operate a stopwatch upon actuating the appropriate joystick. However, in such configurations, there is a delay between the operator actuating the joystick and starting the timer, a delay between the actuator motion stopping and the user stopping the timer, as well as a delay between actuating the joystick and the pilot pressure being high enough to begin moving the respective cylinder. Further, the delays can vary across the different cycle time measurements and between different operators. The present cycle time calibration method allows for a more consistent measuring of the cycle time to more accurately detect functioning of the actuators and the machine overall.

What is claimed is:

1. A work vehicle comprising:

a chassis;

a ground engaging implement configured to move the chassis along a ground surface;

a boom including a first boom portion connected to the chassis, and a second boom portion connected to the first boom portion opposite the chassis;

an arm including a first arm portion connected to the second boom portion, and a second arm portion connected to the first arm portion opposite the second boom portion;

an attachment connected to the second arm portion;

a first actuator including a first portion connected to the chassis and a second portion connected to the boom, the first actuator configured to rotate the boom with respect to the chassis;

a second actuator including a first portion connected to the boom and a second portion connected to the arm, the second actuator configured to rotate the arm with respect to the boom;

a third actuator including a first portion connected to the arm and a second portion connected to the attachment, the third actuator configured to rotate the attachment with respect to the arm;

a first sensor configured to sense a first pressure associated with the first actuator;

a second sensor configured to sense a second pressure associated with the second actuator;

a third sensor configured to sense a third pressure associated with the third actuator; and a processor configured to compare a sensed first pressure to a threshold pressure, compare a sensed second pressure to the threshold pressure, compare a sensed third pressure to the threshold pressure, start a timer to determine a first cycle time of operation of the first actuator if the following conditions are met:

the sensed first pressure is greater than the threshold pressure, the sensed second pressure is less than the threshold pressure, and the sensed third pressure is less than the threshold pressure, analyze if the determined first cycle time is valid, and if the determined first cycle time is valid communicate the determined first cycle time to a user.

2. The work vehicle of claim 1, wherein the processor is further configured to determine a second cycle time of operation for the second actuator, to analyze if the determined second cycle time is valid, and if the determined second cycle time is valid, to communicate the determined second cycle time to the user.

3. The work vehicle of claim 2, wherein the processor is further configured to determine a third cycle time of operation for the third actuator, to analyze if the determined third cycle time is valid, and if the determined third cycle time is valid, to communicate the determined third cycle time to the user.

4. The work vehicle of claim 3, wherein the processor is further configured to start the timer to determine the third cycle time of operation if the following conditions are met:

the sensed first pressure is less than the threshold pressure, the sensed second pressure is less than the threshold pressure, and the sensed third pressure is greater than the threshold pressure.

5. The work vehicle of claim 4, wherein the processor is further configured to stop the timer if any of the following conditions are met while determining the third cycle time:

the sensed third pressure remained above the threshold pressure, the sensed first pressure remained below the threshold pressure, and the sensed second pressure remained below the threshold pressure.

6. The work vehicle of claim 5, wherein the determined third cycle time corresponds to a duration of time between starting the timer to determine the third cycle time and stopping the timer while determining the third cycle time, and wherein the processor is further configured to store multiple third cycle times, to calculate an average third cycle time based upon the stored multiple third cycle times, and to communicate the average third cycle time to the user.

7. The work vehicle of claim 2, wherein the processor is further configured to start the timer to determine the second cycle time of operation if the following conditions are met:

the sensed first pressure is less than the threshold pressure, the sensed second pressure is greater than the threshold pressure, and the sensed third pressure is less than the threshold pressure.

8. The work vehicle of claim 7, wherein the processor is further configured to stop the timer if any of the following conditions are met while determining the second cycle time:

the sensed first pressure remained below the threshold pressure, the sensed second pressure remained above the threshold pressure, and the sensed third pressure remained below the threshold pressure.

9. The work vehicle of claim 8, wherein the determined second cycle time corresponds to a duration of time between starting the timer to determine the second cycle time and stopping the timer while determining the second cycle time, and wherein the processor is further configured to store multiple second cycle times, to calculate an average second cycle time based upon the stored multiple second cycle times, and to communicate the average second cycle time to the user.

10. The work vehicle of claim 1, wherein the processor is further configured to stop the timer if any of the following conditions are met while determining the first cycle time:

the sensed first pressure remained above the threshold pressure, the sensed second pressure remained below the threshold pressure, and the sensed third pressure remained below the threshold pressure.

11. The work vehicle of claim 10, wherein the determined first cycle time corresponds to a duration of time between starting the timer and stopping the timer, and wherein the processor is further configured to store multiple first cycle times, to calculate an average first cycle time based upon the stored multiple first cycle times, and to communicate the average first cycle time to the user.

12. A method for determining a cycle time for a work vehicle having a chassis, a boom rotatably connected to the chassis via a first actuator, an arm rotatably connected to the boom via a second actuator, and an attachment rotatably connected to the arm via a third actuator, the method comprising:

sensing a first pressure proximate the first actuator;

comparing the sensed first pressure to a threshold pressure;

sensing a second pressure proximate the second actuator;

comparing the sensed second pressure to the threshold pressure;

sensing a third pressure proximate the third actuator;

comparing the sensed third pressure to the threshold pressure;

starting a timer if all of the following conditions occur:

the sensed first pressure is greater than the threshold pressure, the sensed second pressure is less than the threshold pressure, and the sensed third pressure is less than the threshold pressure;

further sensing the first pressure after starting the timer;

further sensing the second pressure after starting the timer;

further sensing the third pressure after starting the timer;

stopping the timer when any of the following conditions occur:

the sensed first pressure is less than the threshold pressure, the sensed second pressure is greater than the threshold pressure, and the sensed third pressure is greater than the threshold pressure;

communicating a cycle time to a processor, the cycle time corresponding to a duration of time between starting the timer and stopping the timer;

determining with the processor if the cycle time is valid; and storing the cycle time with the processor if the cycle time is determined to be valid.

13. The method of claim 12, further comprising storing multiple cycle times with the processor, calculating an average cycle time with the processor based upon the stored multiple cycle times, and communicating the average cycle time to the user.

14. The method of claim 12, wherein the cycle time is a first cycle time, the method further comprising determining a second cycle time by starting the timer for a second time if all of the following conditions occur:

the sensed first pressure is less than the threshold pressure, the sensed second pressure is greater than the threshold pressure, and the sensed third pressure is less than the threshold pressure;

further sensing the first pressure after starting the timer for the second time;

further sensing the second pressure after starting the timer for the second time;

further sensing the third pressure after starting the timer for the second time;

stopping the timer for a second time when any of the following conditions occur:

the sensed first pressure is greater than the threshold pressure, the sensed second pressure is less than the threshold pressure, and the sensed third pressure is greater than the threshold pressure;

communicating the second cycle time to the processor, the second cycle time corresponding to a duration of time between starting the timer for the second time and stopping the timer for the second time;

determining with the processor if the second cycle time is valid; and storing the second cycle time with the processor if the second cycle time is determined to be valid.

15. The method of claim 14, further comprising storing multiple second cycle times with the processor, calculating an average second cycle time with the processor based upon the stored multiple second cycle times, and communicating the average second cycle time to the user.

16. The method of claim 14, further comprising determining a third cycle time by starting the timer for a third time if all of the following conditions occur:

the sensed first pressure is less than the threshold pressure, the sensed second pressure is less than the threshold pressure, and the sensed third pressure is greater than the threshold pressure;

further sensing the first pressure after starting the timer for the third time;

further sensing the second pressure after starting the timer for the third time;

further sensing the third pressure after starting the timer for the third time;

stopping the timer for a third time when any of the following conditions occur:

the sensed first pressure is greater than the threshold pressure, the sensed second pressure is greater than the threshold pressure, and the sensed third pressure is less than the threshold pressure;

communicating the third cycle time to the processor, the third cycle time corresponding to a duration of time between starting the timer for the third time and stopping the timer for the third time;

determining with the processor if the third cycle time is valid; and storing the third cycle time with the processor if the third cycle time is determined to be valid.

17. The method of claim 16, further comprising storing multiple third cycle times with the processor, calculating an average third cycle time with the processor based upon the stored multiple third cycle times, and communicating the average third cycle time to the user.

18. A method for determining a cycle time for a work vehicle having a chassis, a boom rotatably connected to the chassis via a first actuator, and an attachment rotatably connected to the boom via a second actuator, the method comprising:

sensing a first pressure proximate the first actuator;

comparing the sensed first pressure to a threshold pressure;

sensing a second pressure proximate the second actuator;

comparing the sensed second pressure to the threshold pressure;

starting a timer if the following conditions occur:

the sensed first pressure is less than the threshold pressure, and the sensed second pressure is greater than the threshold pressure, further sensing the first pressure after starting the timer;

further sensing the second pressure after starting the timer;

stopping the timer when either of the following conditions occur:

the sensed first pressure is greater than the threshold pressure, the sensed second pressure is less than the threshold pressure, and communicating a cycle time to a processor, the cycle time corresponding to a duration of time between starting the timer and stopping the timer;

determining with the processor if the cycle time is valid; and storing the cycle time if the cycle time is determined to be valid.

19. The method of claim 18, further comprising storing multiple cycle times with the processor, calculating an average cycle time with the processor based upon the stored multiple cycle times, and communicating the average cycle time to the user.

* * * * *